US005913711A

United States Patent [19]

Visaisouk

[11] Patent Number: 5,913,711

[45] Date of Patent: Jun. 22, 1999

[54] METHOD FOR ICE BLASTING

[75] Inventor: Sam Visaisouk, Shelby Township, Mich.

[73] Assignee: Universal Ice Blast, Inc., Bellevue, Wash.

[21] Appl. No.: 08/660,905

[22] Filed: Jun. 10, 1996

[51] Int. Cl.[6] ..... B24B 1/00; B24C 1/00

[52] U.S. Cl. ..... 451/39; 451/53; 451/60; 451/99; 451/446; 62/346; 62/354

[58] Field of Search ..... 62/345, 346, 354; 134/6, 7; 222/146.6; 241/DIG. 17; 451/38, 39, 53, 60, 99, 446

[56] References Cited

U.S. PATENT DOCUMENTS

| | | | |
|---|---|---|---|
| 2,549,215 | 4/1951 | Mansted | 62/346 |
| 2,699,403 | 1/1955 | Courts . | |
| 2,749,722 | 6/1956 | Knowles | 62/346 |
| 3,403,532 | 10/1968 | Knowles | 62/354 X |
| 4,389,820 | 6/1983 | Fong . | |
| 4,512,160 | 4/1985 | Mas | 62/346 X |
| 4,538,428 | 9/1985 | Wilkerson | 62/354 |
| 4,617,064 | 10/1986 | Moore . | |
| 4,703,590 | 11/1987 | Westergaard | 451/75 X |
| 4,744,181 | 5/1988 | Moore et al. . | |
| 4,965,968 | 10/1990 | Kelsall . | |
| 5,196,034 | 3/1993 | Ono et al. | 451/78 X |
| 5,203,794 | 4/1993 | Stratford et al. . | |
| 5,249,426 | 10/1993 | Spivak et al. | 62/354 X |
| 5,448,894 | 9/1995 | Niblock et al. | 62/354 |
| 5,520,572 | 5/1996 | Opel et al. | 451/75 X |
| 5,623,831 | 4/1997 | Mesher et al. | 62/346 X |

FOREIGN PATENT DOCUMENTS

| | | | |
|---|---|---|---|
| 1321748 | 8/1993 | Canada . | |
| 4115142 | 11/1992 | Germany | 62/354 |

OTHER PUBLICATIONS

Brochure, MAJA Fine Ice Producing Units, SA 50 E–SA 6000 TL, MAJA Equipment Co., Inc., undated.

Brochure, A–1 Flake Ice Machines, A–1 Refrigeration Co., undated.

"GM investigates ice–impact technology," P. 2, Metalworking, Jul. 7, 1993.

"Ice Blast! The Most Effective Deburring and Degreasing System Available," Brochure, Ice Blast® International, Inc.

*Primary Examiner*—Timothy V. Eley

*Attorney, Agent, or Firm*—Christensen O'Connor; Johnson & Kindness PLLC

[57] ABSTRACT

The invention provides an apparatus and method for continuously delivering ice particulates at high velocity onto a substrate for treating the surface of the substrate. The apparatus includes a refrigerated curved surface that is brought into contact with water to form a thin, substantially uniform, ice sheet on the surface. This ice sheet is of such thickness as to contain stresses so that the sheet is predisposed to fracture into particulates. A doctor-knife is mounted to intercept a leading edge of the ice sheet and to fragment the ice sheet to produce ice particulates. These ice particulates enter into at least one ice-receiving tube that extends substantially along the length of the doctor-knife. Once in the tube, the ice particulates are fluidized by a constant flow of air and are carried into a hose for delivery through an ice-blasting nozzle under pressure. The flow path for the ice particulates in the tube and the delivery hose has a substantially constant cross-sectional area, and flow surfaces are smooth to minimize the likelihood of blockages. Advantageously, the apparatus is able to function for extended periods of time without ice blockages occurring.

13 Claims, 5 Drawing Sheets

56
52
54
58
80
64
52
62
10
50

52
30b
15
14
30a
55
12
10
30
16

64
45
42
40
14
4A,4B
62
42
10
52
12
16
35
34
18
56
4A,4B
50
54
52

METHOD FOR ICE BLASTING

FIELD OF THE INVENTION

The invention provides an apparatus and method for blasting small ice particulates onto surfaces, for cleaning, decontaminating, deburring, or smoothing the surfaces. More particularly, the invention provides ice particulates within a narrow range of size distribution supplied through an apparatus that makes these particulates and motivates them to a required velocity, without intermediate storage of the particulates.

BACKGROUND OF THE INVENTION

In recent years there has been increasing interest in the use of ice blasting techniques to treat surfaces. For certain applications, ice blasting provides significant advantages over chemical surface treatment, blasting with sand or other abrasive materials, hydro-blasting, and blasting with steam or dry ice. The technique can be used to remove loose material, blips and burrs from production metal components, such as transmission channel plates after machining, and even softer material, such as organic polymeric materials, including plastic and rubber components. Because water in either frozen or liquid form is environmentally safe, and inexpensive, ice blasting does not pose a waste disposal problem. The technique can also be used for cleaning surfaces, removing paint or stripping contaminants from a surface, without the use of chemicals, abrasive materials, high temperatures, or steam.

Because of these apparent advantages, ice blasting has generated significant commercial interest which lead to the development of a variety of technologies designed to deliver a high pressure spray containing ice particulates for performing particular surface treatment procedures. Some of these technologies are shown, for example, in U.S. Pat. Nos. 2,699,403; 4,389,820; 4,617,064; 4,703,590; 4,744,181; 4,965,968; 5,203,794; and 5,367,838. Despite all the effort devoted to ice-blasting equipment, the currently available equipment still suffers significant shortcomings that lead to job interruption and downtime for equipment maintenance. This is a particular disadvantage in using ice blasting in a continuous automated production line to treat surfaces of machined parts.

In general, in the prior art equipment, the ice particulates are mechanically sized, a process that can cause partial thawing of ice particulates so that they adhere together, producing larger particulates. As a result, there is not only a wide distribution in the size of ice particulates produced, and the velocity at which these particulates are ejected from a nozzle onto the surface to be treated, but also frequent blockages that necessitate equipment downtime for clearing the blocked area. Moreover, in the available equipment, the ice particulates are retained in storage hoppers, where they are physically at rest, while in contact with each other. This results in ice particulates cohering to form larger ice blocks that ultimately cause blockages with resultant stoppage of the ice blasting operation due to an insufficient supply of ice particulates to the blasting nozzle. In other equipment, the ice particulates flow along a path with abruptly varying cross-sectional area for flow. This frequently causes the accumulation of fine ice particulates in certain low pressure areas. This accumulation also ultimately results in blockage of the apparatus, causing the ice blasting operation to come to an unscheduled stop.

There yet exists a need for ice-blasting apparatus, and a method of ice blasting, that can be carried out continuously, with minimal risk of unscheduled stoppages due to ice blockages forming in the apparatus. Such an apparatus, and method of its operation, will allow more efficient ice-blasting operations, reducing labor costs for unscheduled stoppages, labor costs incurred in freeing the equipment of blockages, and permit more ready integration of ice blasting into an automated production line.

SUMMARY OF THE INVENTION

The invention provides an apparatus for producing ice particulates within a narrow size distribution, and delivering these ice particulates at a predetermined velocity onto a substrate, thereby treating the surface of the substrate to remove contaminants, to deburr, or to otherwise produce a smooth, clean surface. The apparatus of the invention may be operated continuously, with significantly reduced risk of blockage by accumulated ice, as compared to currently-available ice-blasting equipment.

In general, the invention provides an ice particulate-making apparatus that has a curved, refrigerated surface on which a thin ice sheet is formed, which is then fragmented into ice particulates that are fluidized and carried in a conduit of flowing air to impact onto the surface to be treated. The conduit is preferably smooth, and of substantially uniform cross-sectional area for flow, to minimize or eliminate ice particulate agglomeration and consequent clogging of the apparatus.

In accordance with one embodiment of the invention, the apparatus includes a refrigerated device with a curved surface, such as a cylindrical drum that is preferably rotatably mounted with outer surfaces adapted to form a thin layer of ice. In one embodiment, the drum is horizontally mounted in a basin of water. As the drum, that is refrigerated to a surface temperature of at least 0° C., rotates in the basin, a thin curved ice sheet forms on the cylindrical outer surfaces of the drum. An ice breaking tool, such as a doctor-knife, is mounted near the side of the drum that is ice-coated, and extends along the length of the drum. The knife is oriented to intercept a leading edge of the ice sheet and fragment it into ice particulates as the drum rotates. An ice-receiving tube is located adjacent, and extends along the length of, the doctor-knife and is oriented so that a longitudinal slot in the tube is able to receive the ice particulates formed. One end of the tube is coupled to a hose supplying cold air, and the other end is coupled to an ice delivery hose that applies suction to the interior space of the tube. The delivery hose terminates in an ice blasting nozzle. As ice particulates enter into the ice-receiving tube, the particulates are carried by a continuously flowing stream of cold air into the delivery hose and thence into the ice-blasting nozzle. The flow conduit of the ice particulates (tube and hoses) has a substantially smooth (i.e. free of obstructions and surface irregularities) inner surface, and substantially uniform cross-sectional area for flow, thereby avoiding low velocity spots where ice particulates may settle, accumulate, and cause blockages.

In another embodiment, the refrigerated drum is sprayed with water to form the thin ice sheet. The drum may be horizontally mounted, as preferred to form a uniform thickness ice-sheet, or may be inclined at an angle. In one such embodiment of the invention, the refrigerated drum is vertically-oriented and water is sprayed onto the drum to form a thin curved ice sheet. As explained above, a doctor-knife extends along the length of the drum to fragment ice particulates from the sheet into an adjacent co-extensive ice-receiving tube.

In a further alternative embodiment of the invention, the refrigerated cylindrical surface is the interior surface of an annulus. At least one spray nozzle is mounted to direct water onto the cylindrical walls of the annulus to form a thin ice sheet. As before, a doctor-knife extending along the length of the cylindrical wall is used to fragment ice particulates of narrow size distribution from the ice sheet into a slot in an ice-receiving tube that is adjacent to and co-extensive with the knife.

According to the method of the invention, ice particulates may be prepared by freezing water into a thin, curved sheet of ice. This thin, curved ice sheet, already stressed as a result of the curvature, is relatively easily fragmented into ice particulates that are sized dependent on ice sheet thickness and radius of curvature. These ice particulates are drawn by suction pressure into a stream of cold, dry air that fluidizes and sweeps the particulates into a smooth surfaced flow conduit having a substantially constant cross-sectional area for flow. At a terminal end of this flow conduit the ice particulates are ejected onto a surface of a substrate through a nozzle at high velocity to perform deburring, cleaning, or other operations, depending upon the velocity of the ice particulates and air stream.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The invention provides an apparatus, and method, of continuously producing ice particulates, and continuously delivering these ice particulates at a controlled high velocity onto a substrate. The ice particulates are formed from fragmenting a "thin curved sheet" of ice. In the specification and claims, this means a sheet of such curvature and thickness that, as a result, the sheet has residual stresses and a thermal gradient so that it is predisposed to ready fragmentation. An example of such a cylindrical sheet is a sheet about 1.5 mm thick and with a radius of curvature of about 100 mm. Preferably, this sheet is from about 1.0 to about 2.0 mm thick, and has a radius of curvature of about 50 mm to about 150 mm. Clearly, larger or smaller apparatus are also useful and are within the scope of the invention.

The ice particulates are kept in constant motion (and are "fluidized"), according to the invention, so that they do not come to rest relative to any part of the apparatus and do not come into stationary contact with each other to cohere and form larger ice particulate blocks that may cause blockages in the apparatus. Moreover, the flow path along which the ice particulates are carried by a fluidizing gas, such as cold air, is smooth and devoid of such abrupt changes in flow cross-sectional area as may lead to the deposition and subsequent accumulation of ice particulates to form blockages. Preferably, the flow conduit has a diameter of about 25 to about 50 mm. In order to minimize any melting of the ice particulates that may lead to subsequent coherence or adherence and blockage, components of the apparatus that come into contact with ice particulates are preferably fabricated from materials that are smooth and have low thermal conductivity. Plastic materials are preferred, especially non-stick plastics such as TEFLON, that may be used as an inner coating.

The apparatus of the invention may be better understood with reference to the accompanying figures that schematically represent preferred embodiments of the apparatus for making ice particulates and delivering these through a nozzle onto the surface of a substrate. Clearly, other embodiments are also within the scope of the invention, but reference to the preferred embodiments of the figures facilitate an explanation of aspects of the invention.

Figure 1:
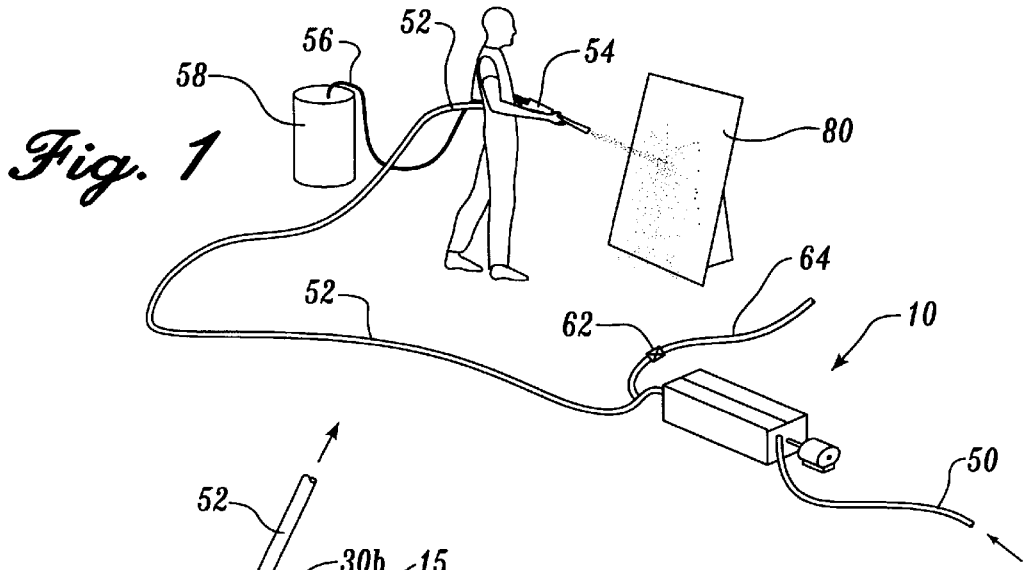
FIG. 1 is an illustration of a worker blasting a surface with ice particulates from an ice blasting device of the invention.

FIG. 1 schematically illustrates the ice-blasting operation. In accordance with the invention, a unique ice maker 10 that produces ice particulates with controlled dimensions, as will be described later, supplies fluidized ice particulates into an ice and air medium delivery hose 52 to which is connected a nozzle 54 attached to a high pressure hose 56 that receives pressured air from device 58, either a compressor or a pressurized cylinder. The high pressure air is supplied through hose 56 to the nozzle 54 and creates a suction behind its entry point in the nozzle that draws ice particulates into the delivery hose 52, as will be explained later, and accelerates the speed of travel of the ice particulates so that they may be ejected from the nozzle 54, under the control of an operator (or under automated control), onto a surface 80 that is to be treated by ice-blasting. As will become apparent later, the unique ice maker 10 of the invention is not itself pressurized, but air is drawn into it through hose 50, and an air-ice particulate mixture is delivered from it through delivery hose 52 to the nozzle 54.

Referring to the preferred embodiment of FIGS. 2, 3, 4A and 4B, an ice maker 10 includes a housing 12 partially filled with water 13. A cylindrical drum 14 with an axial shaft 16 is rotatably mounted such that a portion of its outer cylindrical surface 15 is covered with water, when the housing contains an operating volume of water. The drum is refrigerated, usually by a plurality of channels in the interior of the cylindrical drum that carry a refrigerant (not shown). As illustrated, the drum 14 rotates in a counterclockwise direction around its axial shaft 16 that is coupled to an electric drive motor 18 at a rate that allows the formation of a suitably thick layer of ice on its surface. As the refrigerated drum rotates, water in contact with its outer cylindrical surface freezes to form a thin sheet of ice 20. This sheet of ice is carried around to another side of the drum for removal as ice particulates 20*a*. The ice-cleared drum surface then continues to rotate and re-enters the water to form an ice sheet.

It should be noted that the thin curved ice sheet is subject to stress as a result of its shape and a temperature gradient that extends through its thickness so that it is predisposed to fragment into ice particulates. The size distribution of these ice particulates is dependent upon the thickness, temperature, and the radius of curvature of the ice sheet, which are in turn dependent upon the rate of rotation and temperature of the drum, and the radius of the drum 14.

Figure 2:
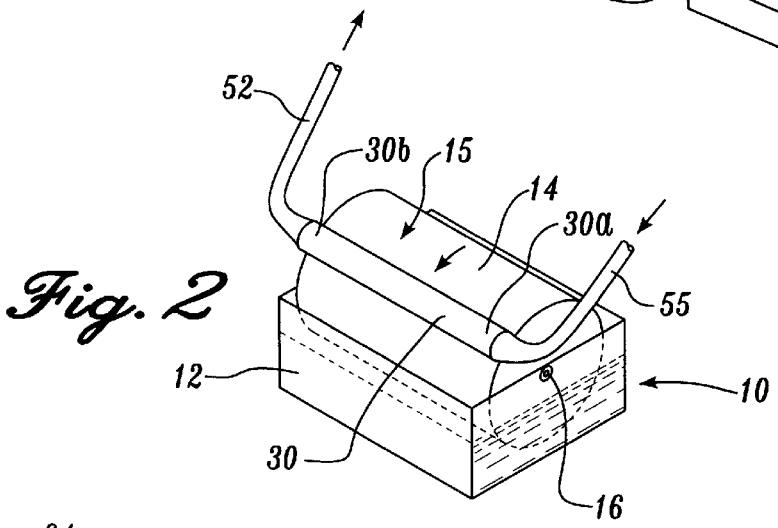
FIG. 2 is a simplified schematic of the ice particulate-making equipment of the invention.
Figure 3:
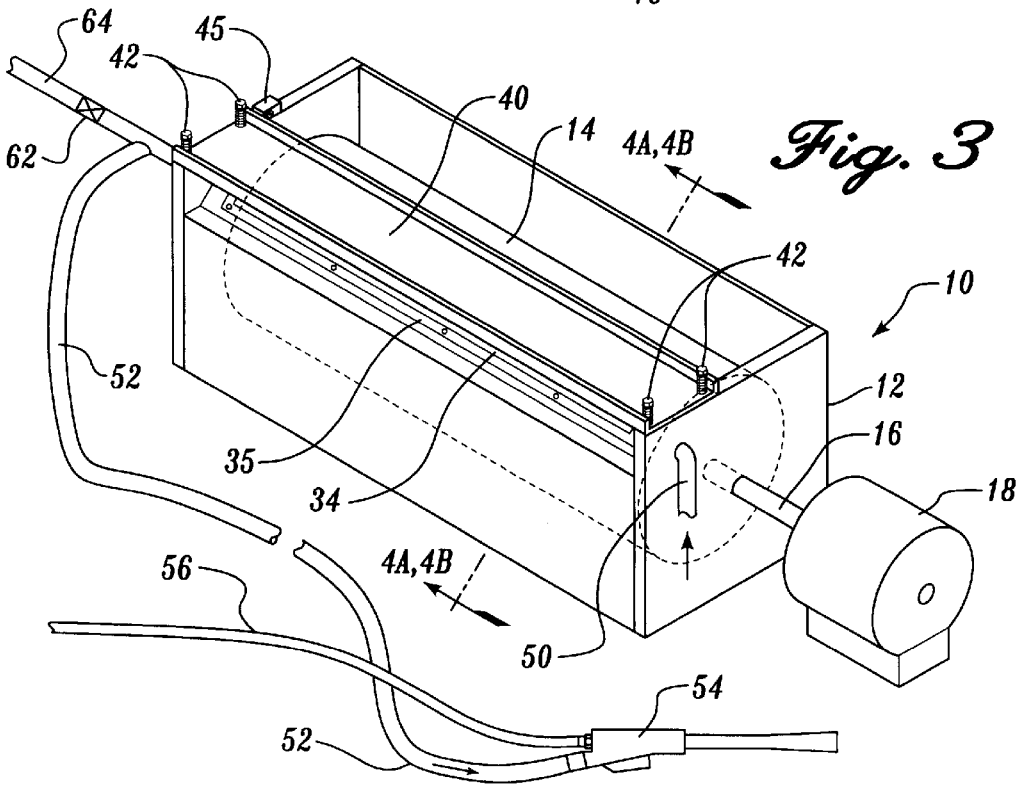
FIG. 3 is a schematic perspective view of an embodiment of an ice-blasting apparatus in accordance with the invention.
Figure 4A:
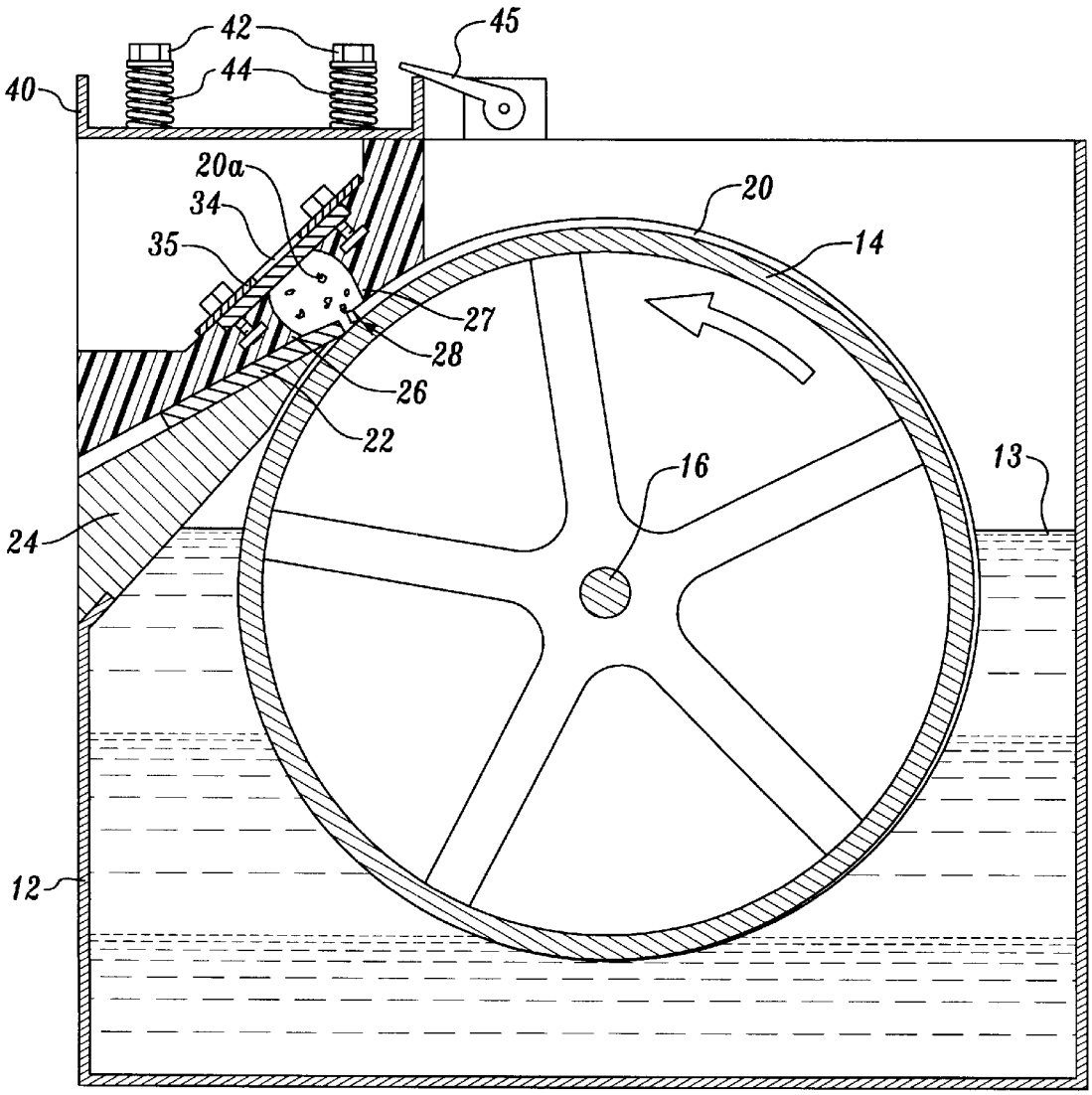
FIG. 4A is an end view of an embodiment of the invention showing details of the ice removal tool and ice-receiving tube of the invention.
Figure 4B:
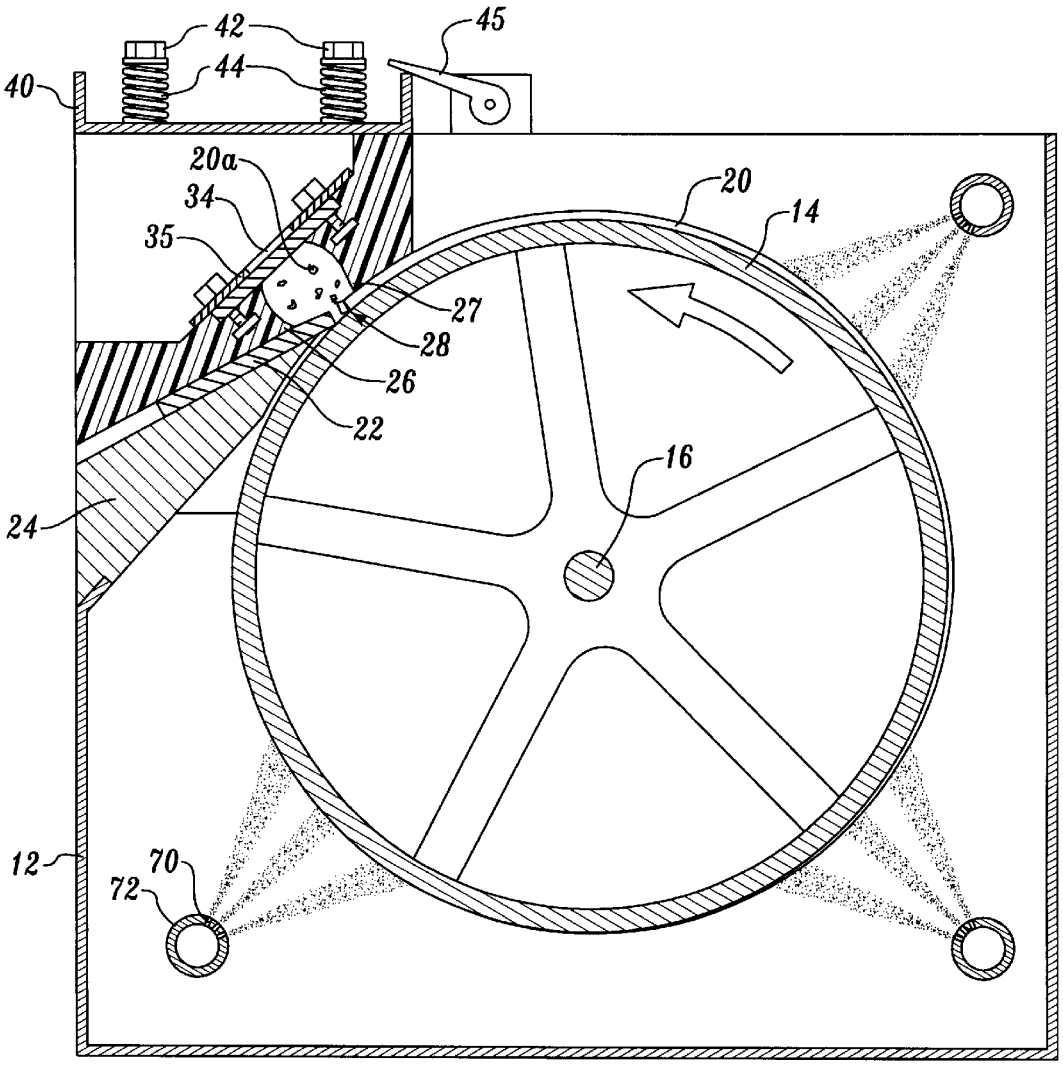
FIG. 4B is an end view of an embodiment of the invention including water spray nozzles for forming an ice sheet on a cylindrical surface of a rotating refrigerated drum.
Figure 4C:
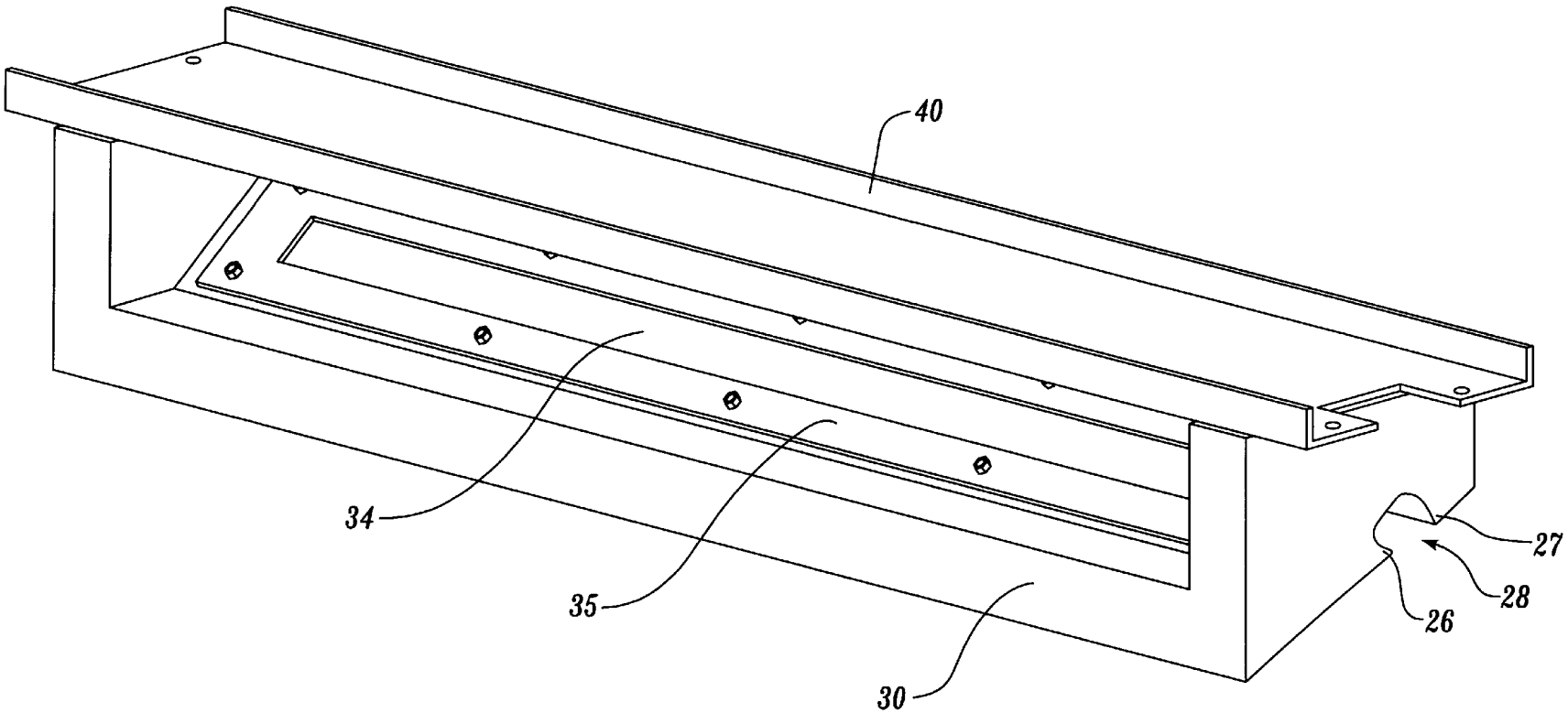
FIG. 4C is a schematic perspective view of an embodiment of the ice-receiving tube of the invention, equipped with an optional window.

The components of the apparatus that fragment the ice sheet are more clearly shown in FIGS. 4A and 4B. An ice-removal tool, or doctor-knife 22 is mounted on a support 24 so that the tip of the tool extends at an angle of about 45° to intercept a leading edge of the ice sheet 20. The doctor-knife 22 and its support 24 extend substantially along the entire length of the cylindrical drum 14, as shown in FIGS. 2 and 3. Thus, as the ice sheet leading edge encounters the tip of the doctor-knife 22, the stressed ice sheet fragments into ice particulates 20*a*. The ice particulates 20*a* then enter a tube of substantially uniform inside cross-sectional area for flow, with a smooth inner surface, as shown in FIGS. 4A and 4C. Within these constraints, the tube may have any one of many possible designs that may readily occur to one of skill in the art who has read this disclosure. In the illustrated embodiment, these ice particulates enter into a slot 28 of an ice-receiving tube 30 that extends substantially along the entire length of the drum 14. The smooth inner-surfaced tube 30, shown in more detail in FIG. 4C, is mounted so that one longitudinal edge 26 of the longitudinal slot is in contact with, and sealed against an upper end of the doctor-knife 22 by mechanical pressure. The other longitudinal edge 27 of the slot 28 curves over above the ice sheet and backward toward the leading edge of the ice sheet while extending downward to a position in touching relationship with the ice sheet 20. The edge 27 is therefore sealed against the surface of the ice sheet. Thus, ice particulates 20*a* are captured in the slot and enter the ice-receiving tube 30 where they are immediately fluidized and carried away, as will be explained later. In order to allow inspection of the interior of the ice-receiving tube 30, the tube is optionally equipped with a longitudinal glass window 34 held in a frame 35. This optional glass window 34 extends along a substantial length of the upper surface of the ice-receiving tube 30, where a corresponding section of the tube has been removed. The ice-receiving tube is affixed to a support bracket 40, that extends along its upper outer surface. The bracket 40 is mounted to the housing 12 and is interconnected with an optional warning system, described below.

The apparatus of the invention preferably has a warning system for detecting when the ice-receiving tube has been overfilled, or is being blocked. Under these circumstances, the continual rotation of the drum, forcing additional particulates into an already full tube, causes the tube 30 to lift away from the drum 14 thereby urging bracket 40 upward. This bracket is held in place, flush with the upper surface of the housing 12, by a series of pairs of compression-retaining bolts 42. Each of these bolts has a surrounding coil spring 44 that it maintains under compression between an upper surface of the bracket 40 and a washer near the top of the retaining bolt 42. Thus, as the bracket is urged upward, the springs compress. This compression is detected by a sensor 45 and automatically sounds an alarm. This system allows early detection of potential or actual blockage so that necessary maintenance can be performed. As explained, however, such blockage should very rarely occur because the ice particulates formed are maintained in a fluidized state, in constant motion, and are not allowed to settle and cohere so that blockages are usually not able to form. However, blockages can result from inadequate fluidizing air supply or misaligned doctor-knife resulting in inadequate fracturing of the ice sheet.

Referring back to FIGS. 2, 3 and 4, an air hose 50 is connected to an air inlet end 30*a* of the ice-receiving tube 30, and a media (ice and air) delivery hose 52 is connected to the other end 30*b* of the tube. Thus, cold compressed air supplied in hose 50 fluidizes ice particulates 20*a*, that are fragmented into tube 30, and carry these particulates into the media delivery hose 52. As will be explained below, the ice-receiving tube 30 is not subjected to high internal pressure by the air supply, but is in fact at close to atmospheric pressure. Preferably, there is a smooth transition from tube 30 to delivery hose 52 so that there are no internal obstructions to ice flow that may cause ice particulates to settle, adhere, cohere, and form blockages. The delivery hose, preferably with a smooth inner lining, terminates in an ice-blasting nozzle 54, that can be manually controlled by an operator or automatically operated. When the nozzle is shut off, a diverter valve 62 reroutes the media through hose 64 to waste disposal. Thus, the ice-making apparatus is able to operate continuously without an accumulation of particulates 20*a* when blasting operations cease temporarily. This avoids the necessity to restart the apparatus, and the unsteady state operation associated with start up, and facilitates recommencing blasting operations.

A high pressure air hose 56 is joined to the rear of the nozzle 54 to draw ice into the nozzle by suction and to impel the particulates at a controlled velocity through the nozzle 54. The connection to the rear of the nozzle, with air directed to the nozzle tip, creates a suction-effect behind the nozzle so that ice particulates are drawn from the ice-receiving tube 30 and propelled to the nozzle 54. Thus, the tube 30 is not pressurized by air entering through hose 50, but air is drawn in by suction through hose 50 air and this air maintains the ice particulates in constant motion in a fluidized state.

In an alternative embodiment of the invention, illustrated in FIG. 4B, the drum 14 does not rotate in a container of water. Instead, the drum 14 is mounted in a container along with at least one spray nozzle that is oriented to spray water onto cylindrical surfaces of the drum, and thereby form an ice sheet on the refrigerated surface. Thus, as shown in FIG. 4B, water distributors 72 extend longitudinally along the length of the horizontally-oriented drum 14, and spray water from nozzle 70 onto the outer surface of the drum. Any excess water collects in the bottom of the container, and may be drained and recycled to the nozzles 70. Clearly, while horizontal orientation of the drum 14 is preferred, to form a thin ice sheet of substantially uniform thickness, other orientations are also possible.

Figure 5:
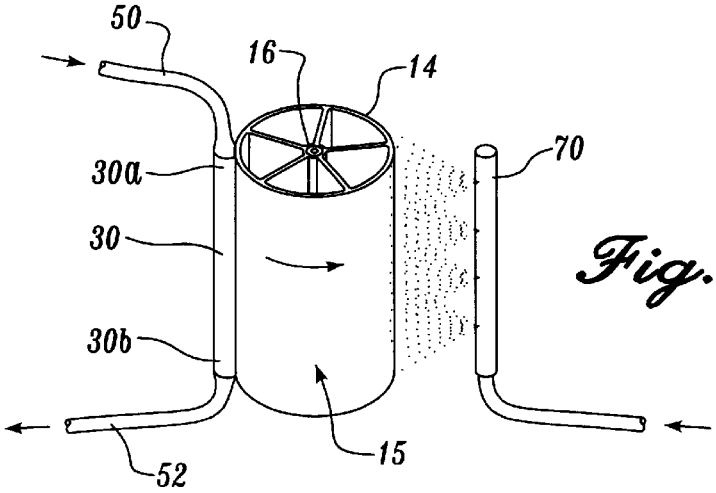
FIG. 5 is a schematic diagram showing another embodiment of the ice particulate-making apparatus of the invention wherein the rotating refrigerated drum is vertically oriented and receives a water spray to form an ice sheet on the outer surfaces of the drum.

An alternative embodiment of the ice-maker apparatus is shown in FIG. 5. In this embodiment, the drum 14 is vertically-oriented and rotates about a central shaft 16. At least one spray nozzle 70, mounted near the cylindrical drum, directs a spray of water onto the cold (at least 0° C.) cylindrical outer surfaces 15 of the drum. This spray of water freezes upon contact with the surfaces into an ice sheet. Once again, the curved ice sheet is broken into ice particulates when a leading edge of the sheet impacts against a front edge of a doctor-knife. The knife is mounted on a support (not shown), and preferably extends substantially along the length of the cylindrical surface parallel to the axial shaft of the drum. An ice-receiving tube 30 extends along the length of the doctor-knife, and a longitudinal slot of the tube intercepts ice particulates, directing these into the space within the tube 30, as explained before.

As before, an air hose 50 is attached to an upper open end 30*a* of the tube 30, while a media delivery hose 52 is connected to the lower open end 30*b* of the receiving tube 30. Thus, air drawn in through hose 50 fluidizes ice particulates in the tube 30 and carries the fluidized particulates into delivery hose 52, and thence to a delivery nozzle 54, as explained above.

Figure 6:
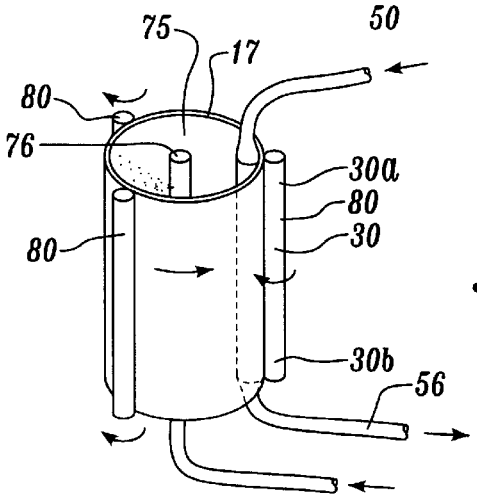
FIG. 6 is yet another preferred embodiment of the ice particulate-making device of the invention wherein the rotating drum has a cylindrical internal surface on which a thin ice sheet is formed and fragmented into an ice-receiving tube.

In a yet further embodiment according to the invention shown in FIG. 6, the ice sheet is formed on an internal cylindrical surface of a refrigerated cylindrical annulus 17. In this embodiment, the refrigerated annulus 17 has an internal cylindrical space 75 surrounded by cylindrical walls. The annulus is held by friction between three rotating shafts 80 disposed in a triangular array against its outer surfaces so that it rotates at a controlled speed as the shafts rotate. Water, preferably from nozzles on a distributor 76, parallel to the central axis of the annulus 17, is sprayed onto the cold surrounding internal cylindrical walls of annulus 17. This water freezes into an ice sheet that is fragmented by a longitudinally extending doctor-knife tool, that is mounted to intercept the leading edge of the ice sheet inside the inner cylindrical space. As explained above, the ice particulates are captured in an ice-receiving tube 30 through a longitudinally extending slot in the tube that extends substantially along the entire length of the surrounding cylindrical surface. An upper end 30*a* of the tube 30 is in fluid communication with an air supply hose 50, while a lower end 30*b* of the tube is in fluid communication with a media delivery hose 56. Thus, air is sucked into the upper open end of the tube, fluidizes ice particulates within the tube, and carries the fluidized ice particulates into the delivery hose 52 to an ice-blasting nozzle 54.

The apparatus also optionally includes a diverter valve 62 for diverting ice particulates into a hose 64 when the nozzle 54 is shut off so that the ice making process is continuous.

Figure 7:
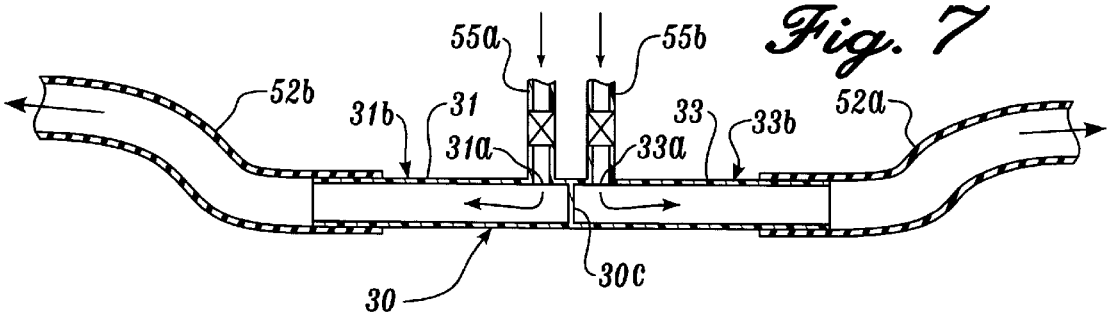
FIG. 7 is a schematic cross-sectional illustration of an ice-particulate receiving tube, divided into two sections, for supplying two streams of fluidized ice particulates.

Clearly, the invention is not limited to the use of a single ice particulate-receiving tube 30. Instead, a series of tubes may be used, such that each tube is able to supply a continuous stream of ice particulates for ice-blasting, or a single tube may be divided into at least two, and possibly a plurality, of tube sections, each able to operate relatively independently. Thus, for example, when the front and rear surfaces of a substrate must be ice blasted, the invention allows simultaneous blasting of both sides. In certain embodiments, nozzles may be mounted on either side of the substrate, to automatically traverse both surfaces, thereby treating both front and rear surfaces of the substrate. In the embodiment shown in FIG. 7, an ice particulate receiving tube 30 is divided by a central diaphragm 30*c* into two tube sections 31 and 33, respectively. Thus, an air supply hose 55*a* enters into the inlet 31*a* of tube section 31, near the diaphragm 30*c*. Preferably, the hose 55*a* is equipped with a control valve 57*a* to assist in controlling the flow of air through tube section 31. As explained above, an ice particulate discharge hose 52*b* is connected to the open end 31*b* of tube section 31, so that ice particulates are continuously drawn from tube section 31 into hose 52*b*, and expelled through the nozzle. Similarly, tube section 33 has an air inlet hose 55*b* attached to its inlet 33*a*. The outlet of the tube section 33*b* is coupled to an ice particulate delivery hose 52*a*, that draws fluidized ice particulates to the nozzle for ice blasting. Thus, it is clear, that receiving tube 30 can be divided into a series of sections for supplying a series of nozzles with ice particulates. Moreover, because the air supply to each nozzle can be individually controlled, the velocity of the ice particulates expelled from a nozzle connected to an ice tube section, can be individually controlled.

As indicated above, nozzles can be connected to mechanical/electronic systems to automatically traverse surfaces of a stationary, or moving substrate. Thus, the method and apparatus of the invention are not limited to manual operation of an ice blast nozzle to treat a surface. Instead, the apparatus is ideally suited for automated cleaning of a continuous series of parts produced on a production line, such as is common in, for example, the automobile industry where the ice blasting apparatus of the invention may be used to deburr, or otherwise treat part surfaces. The invention provides the significant advantage of continuous operation for lengthy periods of time, thereby overcoming a significant problem encountered in prior art apparatus and methods.

The invention also provides a method of ice-blasting surfaces with ice particulates. In accordance with the method, water is frozen into a thin curved sheet of ice, preferably by freezing the water onto a cylindrical surface. The sheet of ice is of such a thickness that temperature differences between its opposing curved faces results in stress that predisposes the ice sheet to being fragmented into ice particulates. This stress-cracked ice sheet is fragmented by impacting a leading edge of the ice sheet with a device, such as a doctor-knife, that extends along the leading edge of the ice sheet. The leading edge of the ice sheet is preferably of substantially uniform thickness along its length for more uniformly-sized ice particulates. Fragmented ice particulates are drawn, through suction, into a tube where the ice particulates are fluidized in cold air without melting. The fluidized ice particulates are then carried away into a delivery hose from which the ice particulates are ejected through a nozzle onto a surface that is being ice-blasted. In order to fluidize, carry and accelerate the speed of the ice particulates entering the tube, high pressure air is introduced into the nozzle, thereby creating an area of low pressure behind its entry point in the nozzle. The low pressure area is in fluid communication with the delivery hose and draws, by suction, ice particulates from the fragmenting step into the tube and thence into the delivery hose. The higher pressure at the vicinity of the nozzle tip, ahead of the entry point of the high pressure air, accelerates the ice particulates for the ice-blasting operation.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, any means-plus-function clauses are intended to cover the structures described herein as performing the recited function, and not only structural equivalents, but also equivalent structures. Thus, although a nail and a screw may not be structural equivalents in that a nail employs a cylindrical surface to secure wooden workpieces together, whereas a screw employs a helical surface, in the environment of fastening wooden workpieces, a nail and a screw may nevertheless be equivalent structures.

The embodiments of the invention in which an exclusive property or privilege is claimed are defined as follows:

1. A method of continuously producing a stream of ice particulates, the method comprising:

(a) freezing water on a curve of surface into a thin, curved sheet of ice, the curved sheet having a radius of curvature, the curvature causing sufficient internal stress in the curved sheet to result in self-fracture of the ice sheet;

(b) harvesting self-fractured ice particulates directly from the curved surface;

(c) maintaining the harvested ice particulates in a fluidized state, thereby preventing significant agglomeration of ice particulates; and (d) blasting the harvested, fluidized ice particulates from a nozzle at a controlled velocity onto a substrate.

2. The method of claim 1, wherein the freezing of water of step (a) comprises freezing on a rotating cylindrical drum.

3. The method, of claim 2, wherein the harvesting of the ice particulates comprises impacting a leading edge of the self-fractured ice sheet with a knife edge to separate ice particulates from the cylindrical drum.

4. The method of claim 3 wherein the harvesting of the ice particulates comprises sweeping the ice particulates into an ice-receiving tube adjacent to the knife edge, the tube having a longitudinal slot oriented along a length of the drum to receive ice particulates.

5. The method of claim 4, wherein the ice-receiving tube is supplied with air at a rate sufficient to sweep collected ice particulates continuously from the tube into a conduit in fluid communication with said tube, and to maintain the ice particulates in a fluidized state.

6. A method for producing and accelerating ice particulates, the method comprising:

(a) forming a thin curved sheet of ice on a surface of a rotating cylindrical drum, the ice sheet having a radius of curvature sufficient to induce self-fracturing of the ice sheet;

(b) continuously harvesting the self-fractured ice particulates directly from the surface of the drum into an ice-receiving tube adjacent to the surface of the drum, by supplying the tube with a sufficient amount of air to fluidize said harvested ice particulates, and sweeping the particulates into an ice-delivery conduit in fluid communication with the tube; and (d) expelling the ice particulates from a terminal end of the conduit, under controlled conditions, onto the surface of a substrate.

7. The method of claim 6, wherein the forming comprises forming on a drum mounted horizontally in a container partially filled with water.

8. The method of claim 6, wherein the forming comprises forming by spraying water onto a cylindrically curved surface of a vertically mounted drum.

9. The method of claim 6, comprising maintaining the ice particulates, after harvesting into the ice-receiving tube, in a fluidized state without significant agglomeration before the expelling of said particulates from the terminal end of the conduit.

10. A method of continuously producing a stream of ice particulates, the method comprising:

(a) continuously freezing water on a curved surface into a thin, curved sheet of ice, a curvature of the surface causing fragmenting of the curved sheet of ice to form ice particulates;

(b) continuously separating fragmented ice particulates from the curved surface by continuously sweeping the separated ice particulates directly into a stream of air sufficient to fluidize the particulates;

(c) maintaining the ice particulates in a fluidized state; and (d) continuously ejecting the fluidized ice particulates under controlled velocity from a nozzle.

11. The method of claim 10, wherein the step of continuously freezing comprises freezing into a cylindrically curved sheet.

12. The method of claim 10, wherein the step of continuously separating and sweeping the ice particles comprises drawing the ice particulates into the stream of air by suction pressure.

13. The method of claim 10, wherein step (b) and step (c) are carried out without, such melting of the ice particulates as to cause significant coherence of ice particulates.

* * * * *

UNITED STATES PATENT AND TRADEMARK OFFICE

CERTIFICATE OF CORRECTION

PATENT NO. : 5,913,711
DATED : June 22, 1999
INVENTOR(S) : S. Visaisouk

It is certified that error appears in the above-identified patent and that said Letters Patent is hereby corrected as shown below:

| COLUMN | LINE | |
|---|---|---|
| Title page, item [22] | | "June 10, 1996" should read --June 7, 1996-- |
| | Attorney, Agent, or Firm | After "O'Connor" delete ";" |
| 9 (Claim 3, | 20 line 1) | After "method" delete "," |
| 10 (Claim 13, | 40 line 2) | After "without" delete "," |

Signed and Sealed this

Twenty-third Day of November, 1999

*Attest:*

Q. TODD DICKINSON

*Attesting Officer*

*Acting Commissioner of Patents and Trademarks*